US010782079B2

(12) United States Patent
Tseng et al.

(10) Patent No.: US 10,782,079 B2
(45) Date of Patent: Sep. 22, 2020

(54) THREE-DIMENSIONAL PULSATING HEAT PIPE, THREE-DIMENSIONAL PULSATING HEAT PIPE ASSEMBLY AND HEAT DISSIPATION MODULE

(71) Applicant: INDUSTRIAL TECHNOLOGY RESEARCH INSTITUTE, Hsinchu (TW)

(72) Inventors: Chih-Yung Tseng, Yunlin County (TW); Kai-Shing Yang, Zhubei (TW); Shih-Kuo Wu, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 39 days.

(21) Appl. No.: 16/242,250

(22) Filed: Jan. 8, 2019

(65) Prior Publication Data

US 2020/0088479 A1 Mar. 19, 2020

(30) Foreign Application Priority Data

Sep. 14, 2018 (TW) ..... 107132491 A

(51) Int. Cl.
*F28F 13/10* (2006.01)
*F28D 15/02* (2006.01)

(52) U.S. Cl.
CPC ..... *F28F 13/10* (2013.01); *F28D 15/0266* (2013.01)

(58) Field of Classification Search
CPC ..... F28D 15/02; F28D 2015/0216; F28D 15/025; F28D 15/0233; F28D 15/0266;
(Continued)

(56) References Cited

U.S. PATENT DOCUMENTS 4,830,100 A * 5/1989 Kato ..... F28D 15/0233 165/104.14
4,921,039 A * 5/1990 Ghiraldi ..... F28D 15/0266 165/104.19
(Continued)

FOREIGN PATENT DOCUMENTS

CN 1153897 A 7/1997
CN 2636418 Y 8/2004
(Continued)

OTHER PUBLICATIONS

Taiwan Patent Office, "Office Action", dated Mar. 15, 2019, Taiwan.
(Continued)

*Primary Examiner* — Jianying C Atkisson
*Assistant Examiner* — Jose O Class-Quinones
(74) *Attorney, Agent, or Firm* — Locke Lord LLP; Tim Tingkang Xia, Esq.

(57) ABSTRACT

A three-dimensional pulsating heat pipe includes a pipe member and a connecting member. The pipe member is coiled around an axis to form a plurality of loop portions, and the loop portions are arranged in order along the axis so as to form a three-dimensional coiled structure. The three-dimensional coiled structure has a heat receiving section, and the pipe member has different effective pipe cross-sectional areas on two opposite sides adjacent to the heat receiving section. The connecting member is connected to two ends of the pipe member, such that the connecting member and the pipe member together form a closed loop.

13 Claims, 17 Drawing Sheets

(58) Field of Classification Search
CPC ..... F28D 15/0275; F28D 2015/0291; F28D 15/043
USPC ..... 165/104.21, 104.26; 29/890.032
See application file for complete search history.

(56) References Cited

U.S. PATENT DOCUMENTS 4,921,041 A * 5/1990 Akachi ..... F28D 15/00 165/104.14
4,921,043 A * 5/1990 Ghiraldi ..... F28D 15/0266 165/104.11
5,091,824 A * 2/1992 Dzwonczyk ..... H05K 7/1424 165/80.4
5,219,020 A * 6/1993 Akachi ..... F28D 15/02 165/104.14
5,238,056 A 8/1993 Scotti et al.
5,332,031 A * 7/1994 Kiga ..... F28D 15/0266 165/104.14
5,396,947 A * 3/1995 Itoh ..... H01L 23/427 165/104.14
5,527,588 A * 6/1996 Camarda ..... B32B 3/20 428/188
5,845,702 A 12/1998 Dinh
5,878,808 A * 3/1999 Rock ..... F04D 25/04 165/104.25
5,884,693 A * 3/1999 Austin ..... A61B 8/546 165/104.22
6,026,890 A * 2/2000 Akachi ..... F28D 15/0233 165/104.26
6,109,337 A * 8/2000 Gomez ..... F25B 23/006 165/10
6,164,368 A * 12/2000 Furukawa ..... F28D 15/0233 165/104.33
6,315,033 B1 * 11/2001 Li ..... F28D 15/0233 165/104.33
6,330,907 B1 * 12/2001 Ogushi ..... F28D 15/043 165/104.26
6,564,861 B1 * 5/2003 Miyazaki ..... F28D 15/0266 165/104.21
6,672,373 B2 1/2004 Smyrnov
6,808,013 B2 * 10/2004 Lai ..... F28F 7/02 165/104.21
8,653,686 B2 * 2/2014 Hinks ..... F03G 7/04 290/1 R
2002/0075652 A1 * 6/2002 Berchowitz ..... F28D 15/0266 361/700
2003/0098588 A1 * 5/2003 Yazawa ..... F03G 7/00 290/43
2005/0029903 A1 * 2/2005 Tadayon ..... F01K 3/185 310/314
2008/0198554 A1 * 8/2008 Holmberg ..... F28D 15/0275 361/709
2009/0323276 A1 * 12/2009 Mongia ..... G06F 1/203 361/679.52
2010/0242502 A1 9/2010 Stautner
2011/0067843 A1 3/2011 Vasiliev, Jr.
2011/0127011 A1 * 6/2011 Agostini ..... F28D 15/0266 165/104.21
2012/0097369 A1 * 4/2012 Agostini ..... F28D 1/05391 165/104.21
2013/0133871 A1 5/2013 Ma et al.
2015/0323261 A1 * 11/2015 Tseng ..... F28D 15/0233 165/104.22

FOREIGN PATENT DOCUMENTS

CN 1632441 A 6/2005
CN 101424491 A 5/2009
CN 101487584 A 7/2009
CN 101936676 A 1/2011
CN 201803624 U 4/2011
CN 101776408 B 8/2011
CN 102157761 A 8/2011
CN 102620586 A 8/2012
CN 102620587 A 8/2012
CN 102628655 B 4/2013
CN 203083412 U 7/2013
CN 203100223 U 7/2013
CN 203203445 U 9/2013
CN 103411458 A 11/2013
CN 105736070 A 7/2016
CN 106461347 A 2/2017
TW I270648 B 1/2007
TW I279899 B 4/2007
TW I303704 B 12/2008
TW I307756 B 3/2009
TW 201116793 A 5/2011
TW I356672 B 1/2012
TW I387718 B 3/2013
TW I579519 B 4/2017
TW I580921 B 5/2017
TW 201802425 A 1/2018

OTHER PUBLICATIONS

W. Srimuang et al., A review of the applications of heat pipe heat exchangers for heat recovery, Renewable and Sustainable Energy Reviews, 2012, 16, 4303-4315.
Sameer Khandekar et al., Closed loop pulsating heat pipes Part B visualization and semi-empirical modeling, Applied Thermal Engineering, 2003, 23, 2021-2033.
Piyanun Charoensawan et al., Closed loop pulsating heat pipes Part A parametric experimental investigations, Applied Thermal Engineering, 2003, 23, 2009-2020.
B.Y Tong et al., Closed-loop pulsating heat pipe, Applied Thermal Engineering, 2001, 21, 1845-1862.
Jason Clement et al., Experimental investigation of pulsating heat pipe performance with regard to fuel cell cooling application, Applied Thermal Engineering, 2013, 50, 268-274.
S. Rittidech et al., Heat-transfer characteristics of a closed-loop oscillating heat-pipe with check valves, Applied Energy, 2007, 84, 565-577.

* cited by examiner

THREE-DIMENSIONAL PULSATING HEAT PIPE, THREE-DIMENSIONAL PULSATING HEAT PIPE ASSEMBLY AND HEAT DISSIPATION MODULE

CROSS-REFERENCE TO RELATED APPLICATIONS

This non-provisional application claims priority under 35 U.S.C. § 119(a) on Patent Application No(s). 107132491 filed in in Taiwan, R.O.C. on Sep. 14, 2018, the entire contents of which are hereby incorporated by reference.

BACKGROUND

1. Technical Field

This disclosure relates to a pulsating heat pipe.

2. Related Art

A conventional pulsating heat pipe (PHP) is consisted of several straight and bent pipes, and it can be divided into the condenser, evaporator and adiabatic sections.

The pulsating heat pipe is a capillary tube. Due to the capillary dimension of the PHP, a train of liquid slugs and vapor bubbles having menisci on their edges is formed because of surface tension. When the evaporator section receives heat to heat up the vapor bubbles therein, the pressure difference between the evaporator section and condenser section occurs. This pressure difference pushes the liquid slugs toward the condenser section where both vapor bubbles and liquid slugs are cooled down. The pressure difference, caused by random distribution and various sizes of the vapor bubbles and the liquid slugs, drives the working fluid to oscillate intensively in the pipes, thereby achieving high thermal transmission efficiency.

SUMMARY

One embodiment of the disclosure provides a three-dimensional pulsating heat pipe. The three-dimensional pulsating heat pipe includes a pipe member and a connecting member. The pipe member is coiled around an axis to form a plurality of loop portions, and the loop portions are arranged in order along the axis so as to form a three-dimensional coiled structure. The three-dimensional coiled structure has a heat receiving section, and the pipe member has different effective pipe cross-sectional areas on two opposite sides adjacent to the heat receiving section. The connecting member is connected to two ends of the pipe member, such that the connecting member and the pipe member together form a closed loop.

One embodiment of the disclosure provides a three-dimensional pulsating heat pipe assembly. The three-dimensional pulsating heat pipe assembly includes two of the aforementioned three-dimensional pulsating heat pipes. The three-dimensional coiled structure of one of the three-dimensional pulsating heat pipes forms a storage space, and the other three-dimensional coiled structure is disposed in the storage space.

One embodiment of the disclosure provides a three-dimensional pulsating heat pipe assembly, which is adapted to be in thermal contact with two heat sources and a cold source. The three-dimensional pulsating heat pipe assembly includes two of the aforementioned three-dimensional pulsating heat pipes. Each of the three-dimensional coiled structure further has heat dissipation section, and the dissipation section and the heat receiving section are respectively located at two opposite sides of the three-dimensional coiled structure. Each of the three-dimensional coiled structures is in a L shape, and the three-dimensional coiled structures are disposed in a mirror-symmetrical manner. The heat receiving sections are located away from each other and configured to be respectively in thermal contact with the two heat sources, and the heat dissipation sections are located adjacent to each other and configured to be in thermal contact with the cold source.

One embodiment of the disclosure provides a heat dissipation module. The heat dissipation module includes a fin-and-tube heat exchanger, a plurality of fillings, a plurality of pipe members and a connecting member. The heat dissipation section includes a plurality of fins and a plurality of heat dissipation pipes, and the plurality of heat dissipation pipes are disposed through the plurality of fins. The plurality of fillings are disposed in the plurality of heat dissipation pipes. The plurality of pipe members each have a smaller pipe cross-sectional area than that of each of the plurality of heat dissipation pipes. The plurality of pipe members are connected to the plurality of heat dissipation pipes so as to form a continuous flow path including a plurality of loop portions that surround an axis. The plurality of loop portions are arranged in order along the axis so as to form a three-dimensional coiled structure. The three-dimensional coiled structure has a heat receiving section. The heat receiving section and the fin-and-tube heat exchanger are respectively located at two opposite sides of the three-dimensional coiled structure, and the pipe member has different effective pipe cross-sectional areas on two opposite sides adjacent to the heat receiving section. The connecting member is connected to two ends of the continuous flow path, such that the connecting member, the plurality of pipe members and the plurality of heat dissipation pipes together form a closed loop.

One embodiment of the disclosure provides a heat dissipation module. The heat dissipation module includes the aforementioned three-dimensional pulsating heat pipe and a generator set. The three-dimensional coiled structure further has a heat dissipation section. The heat dissipation section and the heat receiving section are respectively located at two opposite sides of the three-dimensional coiled structure. The heat receiving section is configured to be in thermal contact with a heat source, and the heat dissipation section is configured to be in thermal contact with a cold source. The generator set is disposed within the connecting member and configured to convert mechanical energy of rotation into electrical energy.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

The drawings may not be drawn to actual size or scale, some exaggerations may be necessary in order to emphasize basic structural relationships, while some are simplified for clarity of understanding, and the present disclosure is not limited thereto. It is allowed to have various adjustments under the spirit of the present disclosure. In the specification, the term "on" may be described as "one is located above another" or "one is in contact with another". In addition, the terms "top side", "bottom side", "above" and "below" are used to illustrate but limit the present disclosure. The term "substantially" is referred to the complete or nearly complete extent or degree of a structure, which means that it is allowable to have tolerance during manufacturing.

Figure 1:
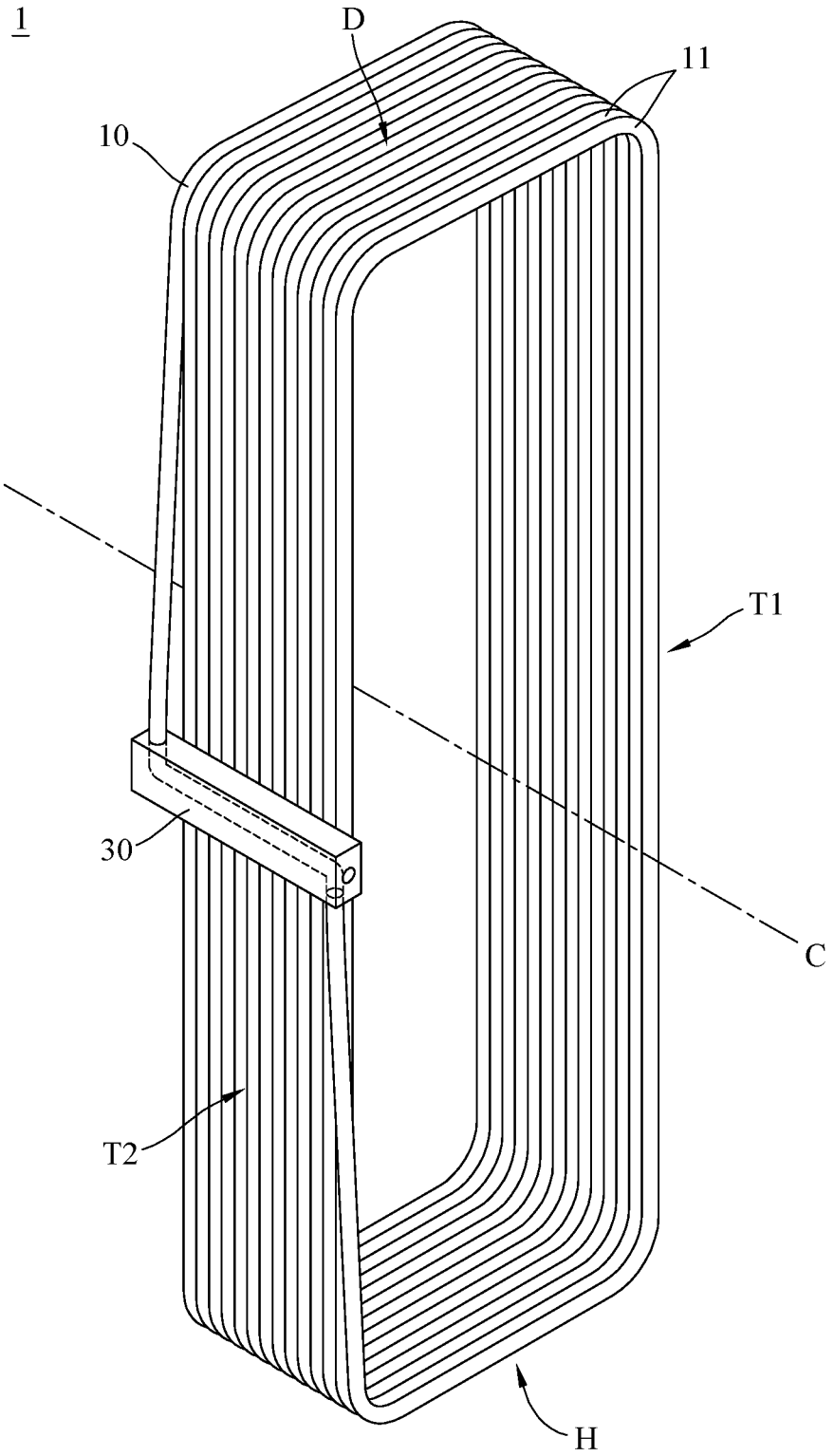
FIG. 1 is a perspective view of a three-dimensional pulsating heat pipe in accordance with a first embodiment of the disclosure.
Figure 2:
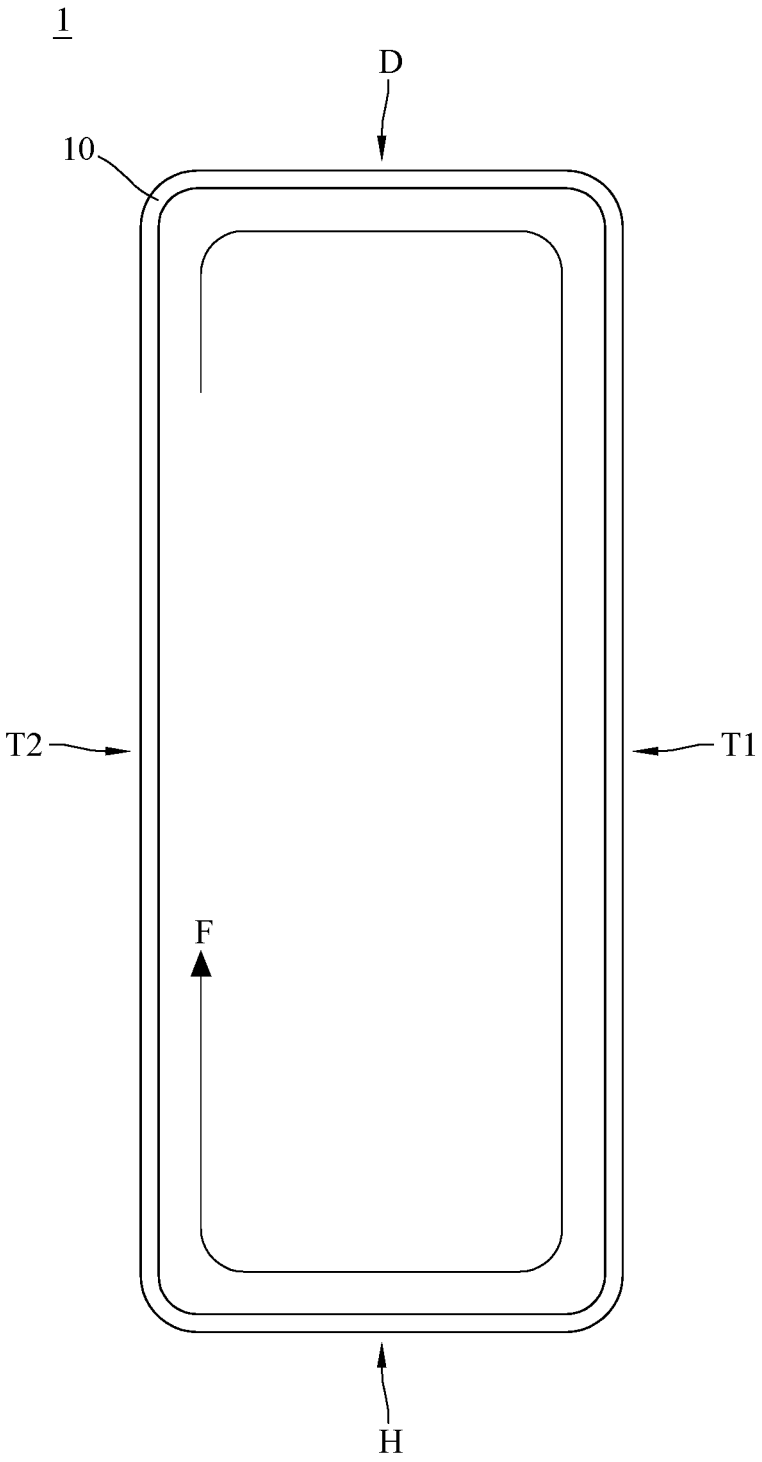
FIG. 2 is a front view of the three-dimensional pulsating heat pipe in FIG. 1.
Figure 3:
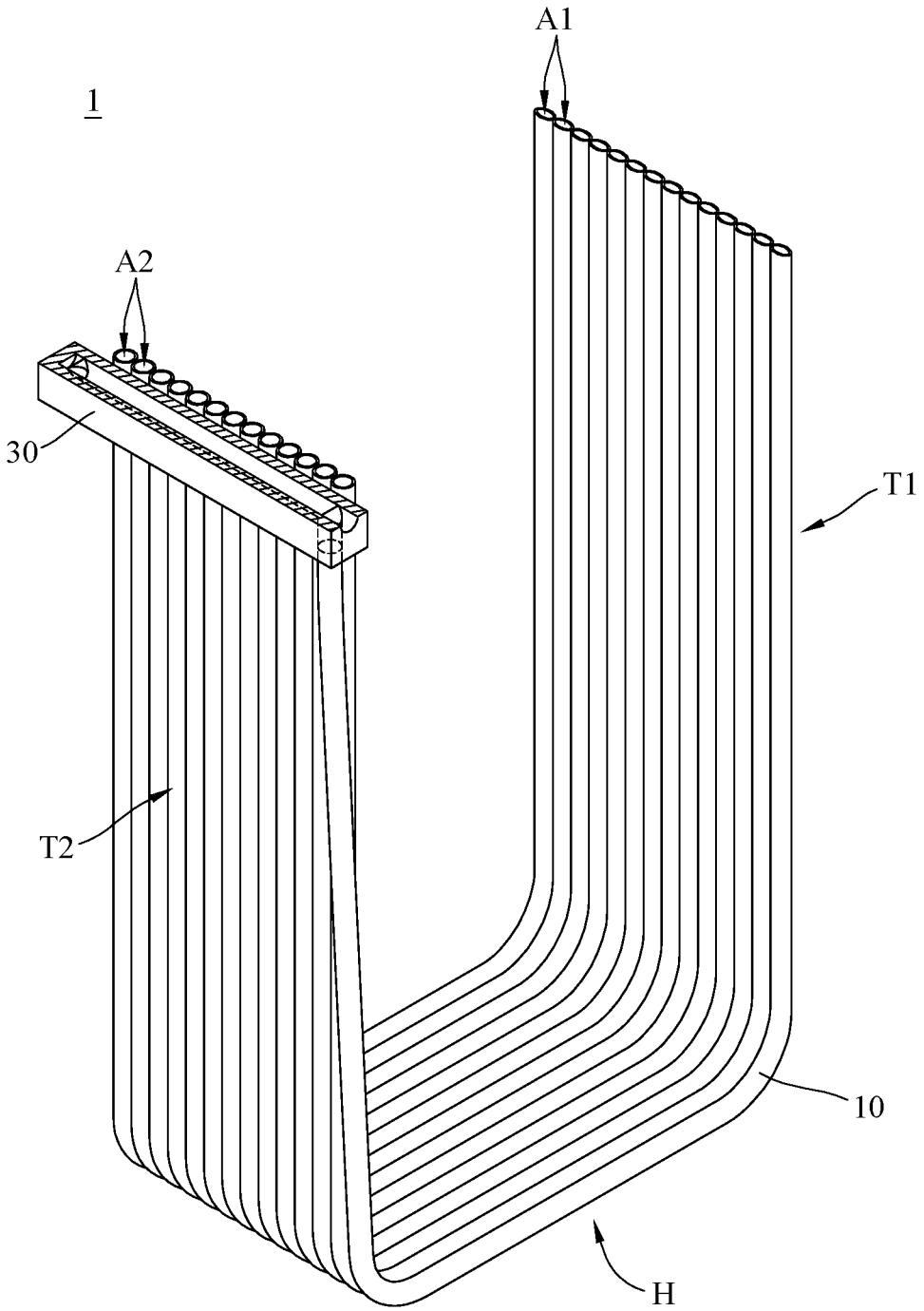
FIG. 3 is a cross-sectional view of the three-dimensional pulsating heat pipe in FIG. 1.

Please refer to FIG. 1 to FIG. 3, FIG. 1 is a perspective view of a three-dimensional pulsating heat pipe in accordance with a first embodiment of the disclosure, FIG. 2 is a front view of the three-dimensional pulsating heat pipe in FIG. 1, and FIG. 3 is a cross-sectional view of the three-dimensional pulsating heat pipe in FIG. 1.

The first embodiment provides a three-dimensional pulsating heat pipe (PHP) 1. The three-dimensional pulsating heat pipe 1 includes a pipe member 10 and a connecting member 30.

The pipe member 10 is coiled around an axis Cm to form a plurality of loop portions 11, and the loop portions 11 are arranged in order and stacked on one another along the axis C so as to form a three-dimensional coiled structure. That is, these loop portions 11 are stacked together from top to bottom along the axis C to form a stereoscopic three-dimensional coiled structure.

Two ends of the pipe member 10 are connected to each other via the connecting member 30, such that the connecting member 30 and the pipe member 10 together form a closed loop. In such a case, the three-dimensional pulsating heat pipe 1 is also called a closed-loop PHP (CLPHP). Working fluid can be circulated through the closed loop for transferring heat. The connecting member 30 is also configured as a fluid supply for supplying the working fluid (e.g., water, methanol, acetone, or any pure liquid or solution and the like) into the pipe member 10 with a filling ratio of approximately 30 to 80%.

The three-dimensional coiled structure has a heat receiving section H and a heat dissipation section D respectively on two opposite sides thereof (e.g., the upper and lower sides of the three-dimensional coiled structure shown in FIG. 2), and the three-dimensional coiled structure further has a first adiabatic section T1 and a second adiabatic section T2 located between the heat receiving section H and the heat dissipation section D. The heat receiving section H is also called "evaporator section", the heat dissipation section D is also called "condenser section", and the adiabatic section is also called "insulation section". The heat receiving section H and the heat dissipation section D are respectively configured to be in thermal contact with a heat source and a cold source. The heat source is, for example, a laser diode light, an insulated gate bipolar transistor or a chip processor, and the cold source is, for example, a heat dissipation fins module.

In this embodiment, the pipe member 10 in at least a part of one of the adiabatic sections may be compressed and deformed during manufacturing, such that the pipe member 10 in the two adiabatic sections have different effective pipe cross-sectional areas. This causes the adiabatic sections to have different flow resistances, such that the working fluid tends to flow towards the side that has a relatively small flow resistance, thereby increasing the flow rate of the working fluid.

In detail, as shown in FIG. 3, in this embodiment, a portion of the pipe member 10 which is located in the first adiabatic section T1 had been compressed and deformed so that the pipe member 10 in the first adiabatic section T1 is in a flat shape; another portion of the pipe member 10 which is located in the second adiabatic section T2 remain the same so that the pipe member 10 in the second adiabatic section T2 remains in a round shape. In such a case, the pipe member 10 in the first adiabatic section T1 has a larger effective pipe cross-section area compared to that in the second adiabatic section T2. The effective pipe cross-sectional area means an area on the cross-portion of the pipe member 10 where the working fluid is allowed to flow through. Specifically, the pipe member 10 in the first adiabatic section T1 has a first effective pipe cross-sectional area A1, and the pipe member 10 in the second adiabatic section T2 has a second effective pipe cross-sectional area A2 which is smaller than the first effective pipe cross-sectional area A1, such that the flow resistance in the first adiabatic section T1 is larger than that in the second adiabatic section T2. As such, when the heat receiving section H receives heat to heat and vaporize the working fluid, and a pressure difference created thereby between the heat receiving section H and the heat dissipation section D pushes the liquid-vapor mixture of the working fluid to flow, the liquid-vapor mixture of the working fluid in the heat receiving section H tends to flow towards the second adiabatic section T2. Therefore, in the closed loop, the working fluid tends to flow along a specific direction (e.g., direction F in the figure) and to automatically form a circulation, which helps to increase the flow rate of the working fluid. In this embodiment, a ratio of the first effective pipe cross-sectional area A1 to the second effective pipe cross-sectional area A2 ranges from, for example, 0.3 to 0.7.

In the three-dimensional pulsating heat pipe 1, the adjacent loop portions 11 are in tight contact with each other in order to prevent the existence of a gap in the axial direction C therebetween. This helps to prevent an invalid contact area between the heat receiving section H and the heat source so as to maximum heat transfer rate, but the present disclosure is not limited thereto. In other embodiments, there can be a gap between the adjacent loop portions. Additionally, in this embodiment, since the pipe member of the three-dimensional pulsating heat pipe is coiled around an axis to form the loop portions and the loop portions are tightly stacked on one another, the loop portions together form a compact contact surface with small or no gaps thereon, such that the three-dimensional pulsating heat pipe does not require a small radius of curvature of the pipe member to increase effective thermal contact area, thereby does not require additional specific jigs for bending task, either. Accordingly, the three-dimensional pulsating heat pipe of the present disclosure features low manufacturing cost in comparison with the conventional pulsating heat pipes.

In this embodiment, the pipe member 10 is made of, for example, copper, thus the three-dimensional pulsating heat pipe 1 features a high thermal conductivity contributed by the property of copper. However, the present disclosure is not limited to the materials of the pipe member. In other embodiments, the pipe member 10 may be made of other materials that also have a high thermal conductivity.

Furthermore, based on a theoretical inner diameter range of a pulsating heat pipe, the inner diameter of the pipe member 10 can be determined according to the type of the working fluid; by doing so, the working fluid can form into interspersed vapor bubbles (also called "vapor plugs") and liquid slugs in the pipe member 10; in the other words, the working fluid can be separated into different segments of liquid slugs that are spaced apart and separated by vapor bubbles within the closed loop of the pipe member 10. For example, in the case that the working fluid is mercury or sodium, the inner diameter of the pipe member 10 may range from 1.0 mm to 8.0 mm; in the case that the working fluid is water, the inner diameter of the pipe member 10 may range from 1.0 mm to 5.0 mm.

In this embodiment, the heat receiving section H is located at a level lower than the heat dissipation section D; that is, the heat receiving section H is located underneath the heat dissipation section D. In such a case, the three-dimensional pulsating heat pipe is defined as being in a positive 90-degree position (or in an upright position). As such, the heated vapor bubbles of the working fluid are able to push liquid-vapor mixture of the working fluid to flow upwards to the heat dissipation section D due to buoyancy of the vapor bubbles. That is, the pressure difference forces the liquid slugs and vapor bubbles to move between the heat receiving section H and the heat dissipation section D.

Figure 4:
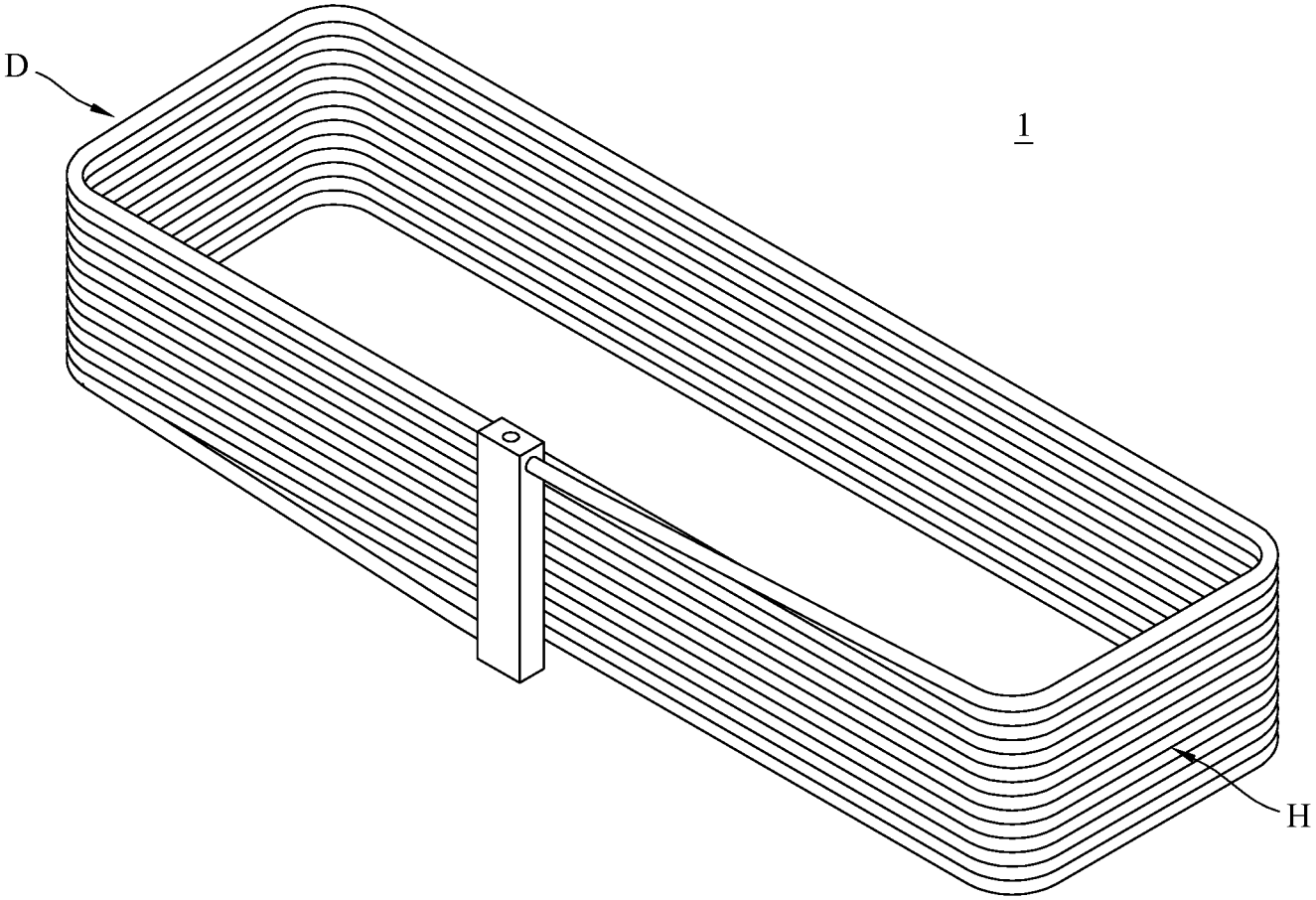
FIG. 4 is another operating position of the three-dimensional pulsating heat pipe in FIG. 1.

It is noted that the three-dimensional pulsating heat pipe 1 is able to operate in another position. Please refer to FIG. 4 and FIG. 5. FIG. 4 is another operating position of the three-dimensional pulsating heat pipe in FIG. 1, and FIG. 5 is yet another operating position of the three-dimensional pulsating heat pipe in FIG. 1.

Figure 5:
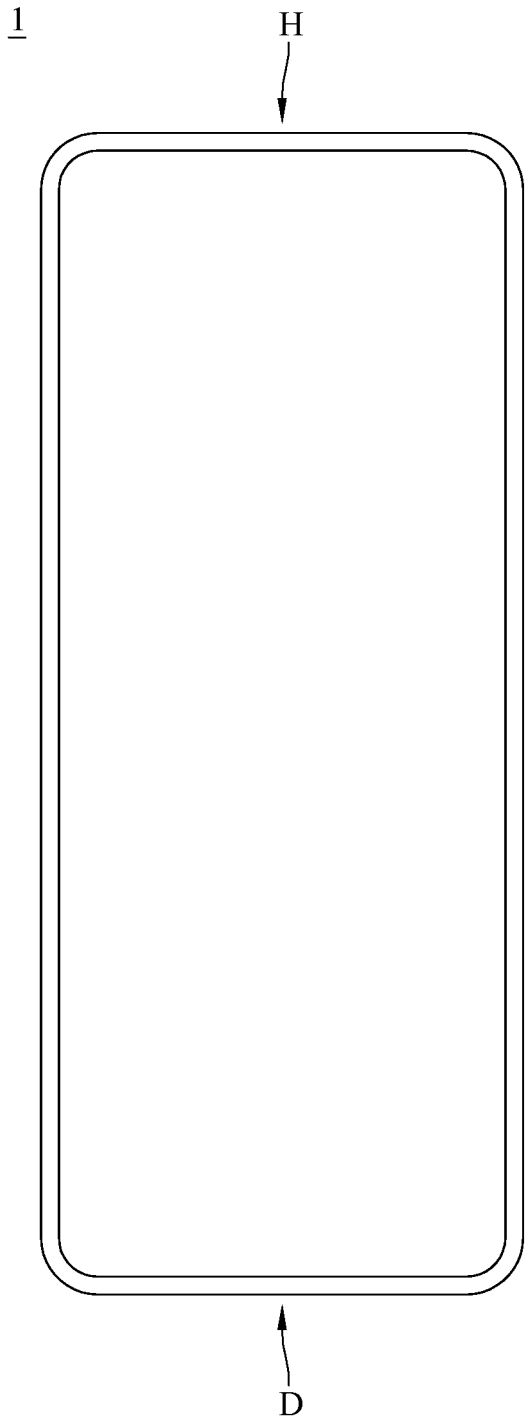
FIG. 5 is yet another operating position of the three-dimensional pulsating heat pipe in FIG. 1.

As described above, the working fluid automatically flows along a specific direction due to the unbalanced flow resistance on two sides of the heat receiving section H caused by the difference between the effective pipe cross-sectional areas of the adiabatic sections T1 and T2, and thus the three-dimensional pulsating heat pipe 1 is still able to operate at the desired level for cooling whether it is being placed horizontally (as shown in FIG. 4) or being placed in a negative 90-degree position (as shown in FIG. 5, the three-dimensional pulsating heat pipe 1 is in an upside-down position compared to FIG. 2). As shown in the figures, when the three-dimensional pulsating heat pipe 1 is placed horizontally, the heat receiving section H and the heat dissipation section D are located at the same level; when the three-dimensional pulsating heat pipe 1 is placed in the negative 90-degree position, the heat receiving section H is located at a level higher than the heat dissipation section D (i.e., the heat receiving section H is located above the heat dissipation section D). In more detail, since there exists a difference in flow resistance (or pressure difference) on two sides of the heat receiving section H, when the three-dimensional pulsating heat pipe 1 is placed in the negative 90-degree position and the vapor bubbles is heated to expand its volume in the heat receiving section H, the vapor bubbles tend to flow towards where the flow resistance is relatively small and therefore to push the liquid slugs towards the heat dissipation section D underneath the heat receiving section H, forming a flow circulation in the closed loop.

Table 1 shows a comparison between simulation results of the three-dimensional pulsating heat pipe 1 respectively operating in the positive 90-degree position and in the negative 90-degree position.

TABLE 1

| Operating position | Positive 90-degree position | Negative 90-degree position |
|---|---|---|
| Average temperature at heat receiving section (° C.) | 114 | 117 |
| Thermal resistance (K/W) | 0.0764 | 0.0799 |

Note:
the heating power form the heat source to the heat receiving section is 800 W.

As seen in Table 1, a performance degradation rate is only 5% when the three-dimensional pulsating heat pipe 1 is operating in the negative 90-degree position compared to operating in the positive 90-degree position. The performance degradation rate is a ratio between the thermal resistances. Therefore, according to Table 1, the cooling effect provided by the three-dimensional pulsating heat pipe 1 in the negative 90-degree position is as good as the cooling effect provided by the three-dimensional pulsating heat pipe 1 in the positive 90-degree position.

In addition, Table 2 shows a comparison between simulation results of the three-dimensional pulsating heat pipe 1 and a conventional pulsating heat pipe both in the positive 90-degree position. Said conventional pulsating heat pipe is a flat capillary pipe.

TABLE 2

| | Three-dimensional pulsating heat pipe 1 | Conventional pulsating heat pipe |
|---|---|---|
| Operating position | Positive 90-degree position | Positive 90-degree position |
| Filling volume (ml) | 30 | 21 |
| Filling ratio | 35% ± 5% | 35% ± 5% |
| Heating power (W) | 600 | 300 |
| Average temperature at heat receiving section (° C.) | 105 | 100 |
| Area of heat receiving section ($cm^2$) | 30 | 75 |
| Heat transmission distance (cm) | 35 | 30 |
| Maximum heat flux ($W/cm^2$) | 20 | 4 |

According to Table 2, the maximum heat flux of the conventional pulsating heat pipe is 4 $W/cm^2$, and the maximum heat flux of the three-dimensional pulsating heat pipe 1 is 20 $W/cm^2$ and is approximately five times larger than the maximum heat flux of the conventional pulsating heat pipe.

As shown in FIG. 4, in the case that the heat receiving section H, the heat dissipation section D, the first adiabatic section T1 and the second adiabatic section T2 of the three-dimensional pulsating heat pipe 1 are all located at the same level; that is, the three-dimensional pulsating heat pipe 1 in FIG. 4 is placed horizontally. However, the present disclosure is not limited thereto. In other embodiments, when the heat receiving section and the heat dissipation section are located at the same level, the first adiabatic section and the second adiabatic section may be located at different level; that is, one of the first adiabatic section and the second adiabatic section may be placed in contact with the ground.

In this embodiment, the pipe member 10 in the entire first adiabatic section T1 are in a flat shape, but the present disclosure is not limited thereto. In other embodiments, there may be only a portion of the first adiabatic section been compressed and deformed, such that only a portion of the first adiabatic section has a smaller effective pipe cross-sectional area. In another embodiment, it may compress and deform both the first adiabatic section and the second adiabatic section, but the first adiabatic section and the second adiabatic section still have different cross-sectional areas. Furthermore, in yet another embodiment, it may also compress and deform the heat receiving section and the heat dissipation section. For example, in one configuration, it may compress and deform both the first adiabatic section and the heat receiving section, and the pipe member 10 in both the second adiabatic section and the heat dissipation section remains in round pipe; in another configuration, it may compress and deform the first adiabatic section, the heat receiving section and the heat dissipation section, and the pipe member 10 in the second adiabatic section remains in round pipe.

In addition, the present disclosure is not limited to the shape of pipe in the first adiabatic section T1 and the second adiabatic section T2. In other embodiments, the pipe member in the first adiabatic section and the second adiabatic section may respectively have a square shape and a round shape that have different effective pipe cross-sectional areas; alternatively, the pipe member in both the first adiabatic section and the second adiabatic section may be in a round shape and have different effective pipe cross-sectional areas.

In this embodiment, the three-dimensional coiled structure is rectangular, and the heat receiving section H and the heat dissipation section D are substantially the same in length, but the present disclosure is not limited thereto. In other embodiments, the three-dimensional coiled structure may be formed in other shapes and the heat receiving section and the heat dissipation section may be different in length. For example, please refer to FIG. 6, which is a front view of a three-dimensional pulsating heat pipe in accordance with a second embodiment of the disclosure. It is noted that a detailed description of the similar features between the first embodiment and the following embodiments may not be repeated.

Figure 6:
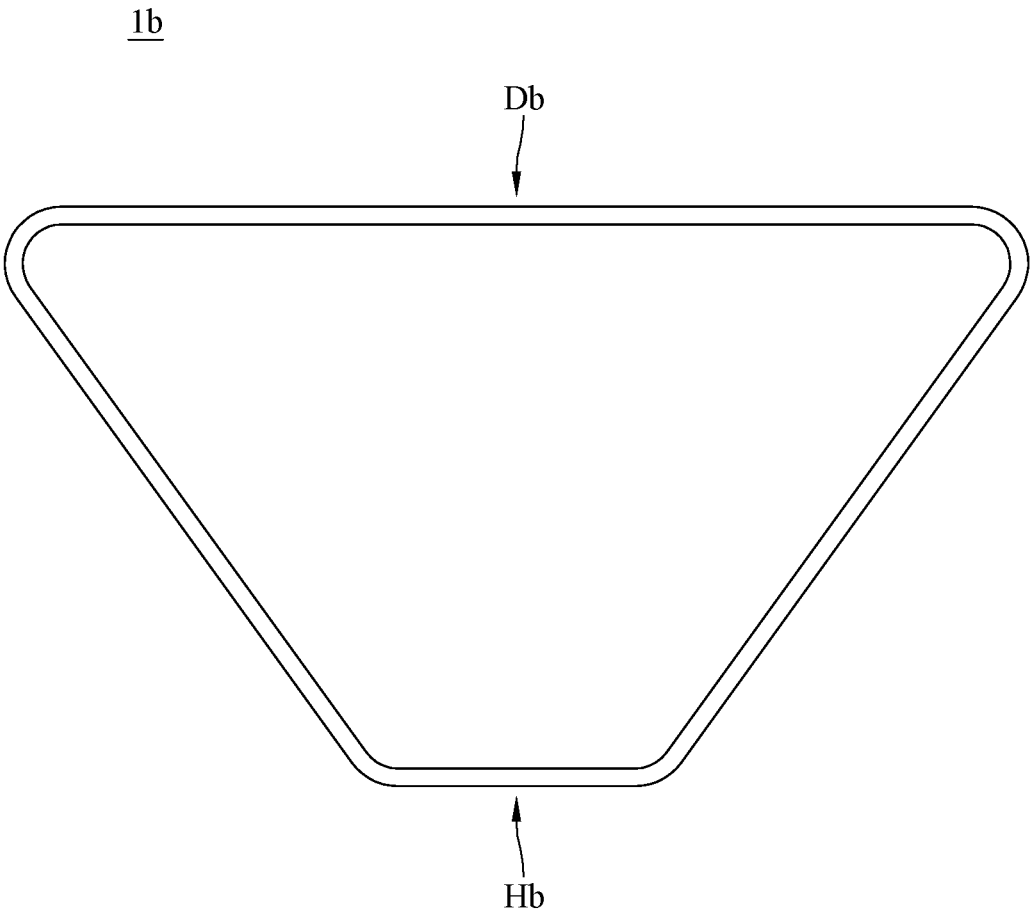
FIG. 6 is a front view of a three-dimensional pulsating heat pipe in accordance with a second embodiment of the disclosure.

The second embodiment provides a three-dimensional pulsating heat pipe 1*b*. The three-dimensional pulsating heat pipe 1*b* has a configuration similar to that of the three-dimensional pulsating heat pipe 1 in the first embodiment. One of the differences between these two embodiments is that the three-dimensional pulsating heat pipe 1*b* has a three-dimensional coiled structure being trapezoidal. In such a case, a heat receiving section Hb and a heat dissipation section Db are different in length. As shown in FIG. 6, the length of the heat dissipation section Db is larger than the length of the heat receiving section Hb, but the present disclosure is not limited thereto. In other embodiments, the length of the heat receiving section may be larger than the length of the heat dissipation section.

Figure 7:
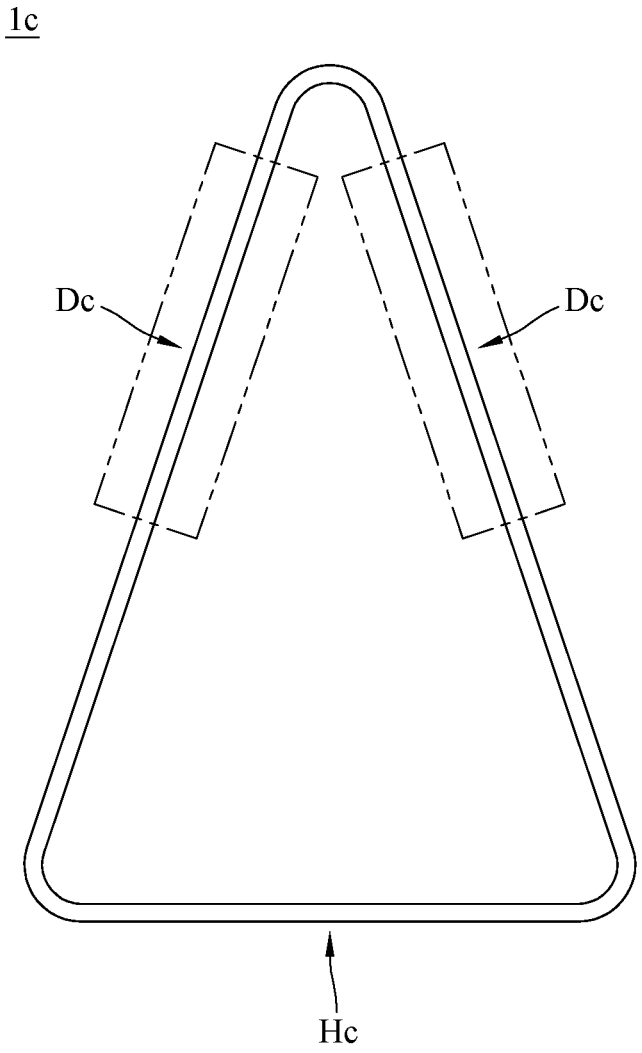
FIG. 7 is a front view of a three-dimensional pulsating heat pipe in accordance with a third embodiment of the disclosure.

However, the present disclosure is not limited thereto. In other embodiments, the three-dimensional coiled structure may be triangular, in an L or oval shape. For example, please refer to FIG. 7, which is a front view of a three-dimensional pulsating heat pipe in accordance with a third embodiment of the disclosure.

The third embodiment provides a three-dimensional pulsating heat pipe 1*c*. The three-dimensional pulsating heat pipe 1*c* has a configuration similar to that of the three-dimensional pulsating heat pipe 1 in the first embodiment. One of the differences between these two embodiments is that the three-dimensional pulsating heat pipe 1*c* has a three-dimensional coiled structure being triangular. In detail, the three-dimensional coiled structure has two heat dissipation sections Dc and a heat receiving section Hc respectively located on different sides of the triangle.

Figure 8:
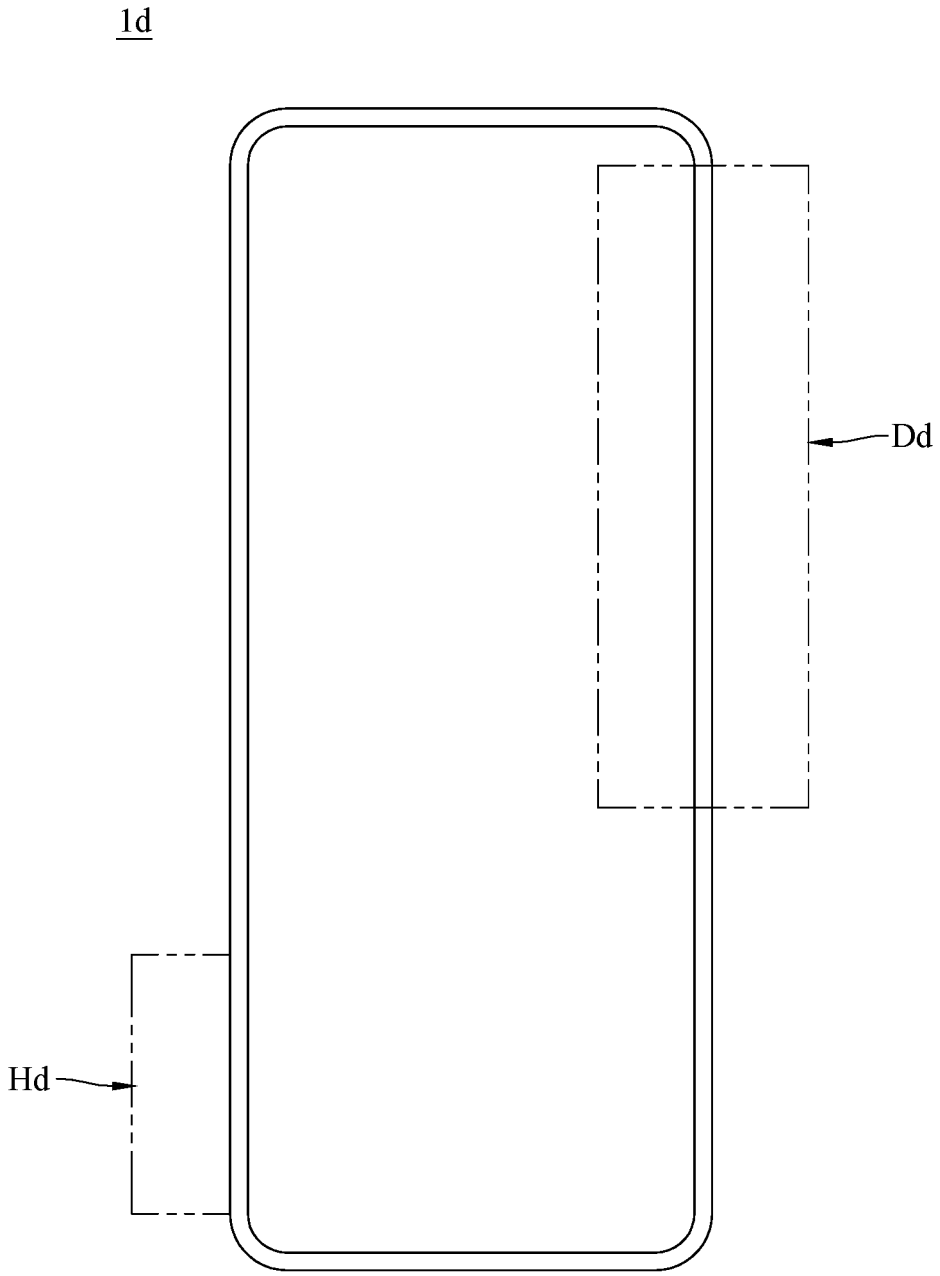
FIG. 8 is a front view of a three-dimensional pulsating heat pipe in accordance with a fourth embodiment of the disclosure.
Figure 9:
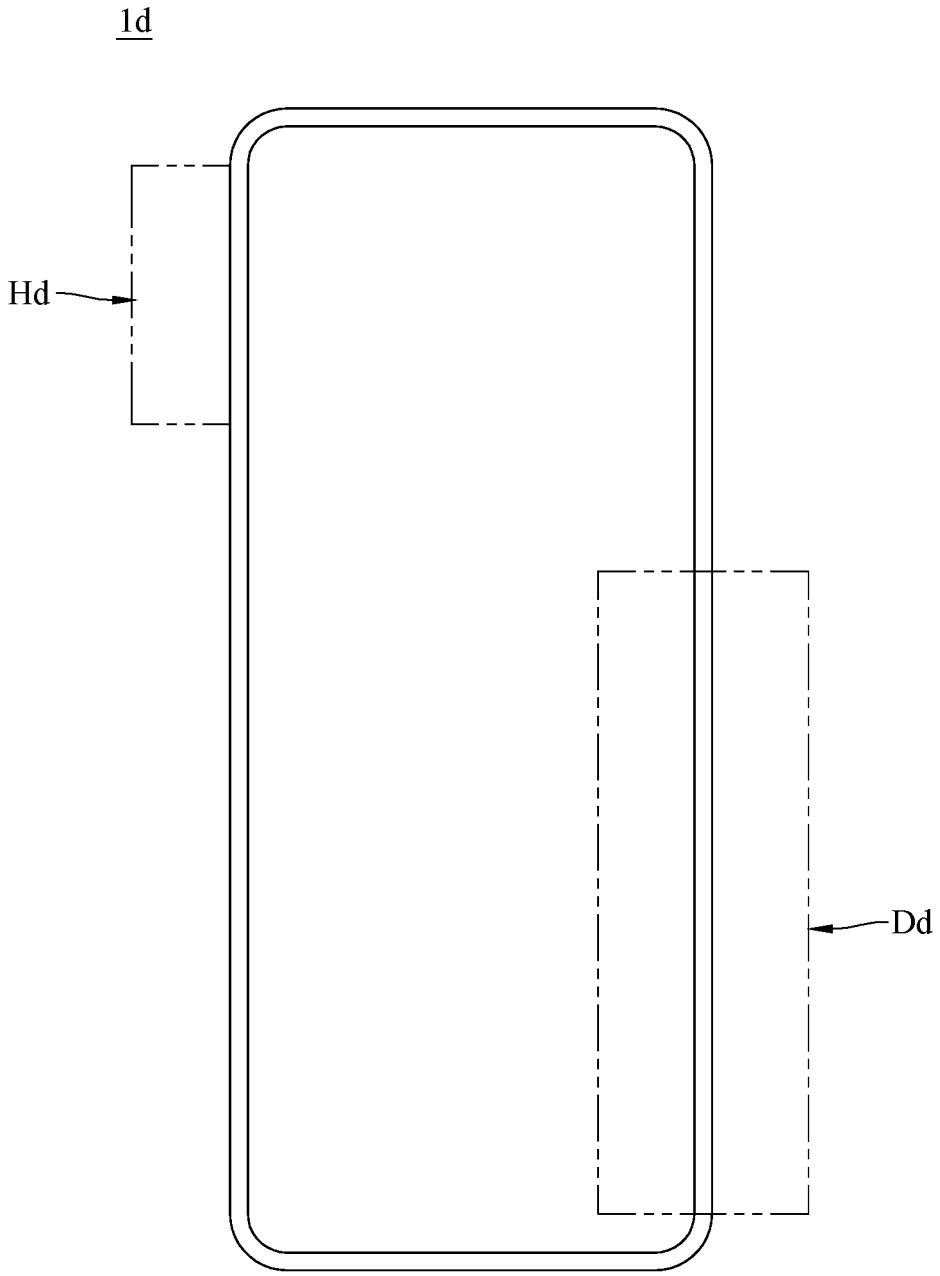
FIG. 9 is another operating position of the three-dimensional pulsating heat pipe in FIG. 8.

Then, please refer to FIG. 8 and FIG. 9. FIG. 8 is a front view of a three-dimensional pulsating heat pipe in accordance with a fourth embodiment of the disclosure, and FIG. 9 is another operating position of the three-dimensional pulsating heat pipe in FIG. 8.

The fourth embodiment provides a three-dimensional pulsating heat pipe 1*d*. The three-dimensional pulsating heat pipe 1*d* has a configuration similar to that of the three-dimensional pulsating heat pipe 1 in the first embodiment. One of the differences between these two embodiments is that the three-dimensional pulsating heat pipe 1*d* has a heat receiving section Hd and a heat dissipation section Dd respectively located on two opposite long sides of a three-dimensional coiled structure, and the heat receiving section Hd and the heat dissipation section Dd are respectively located close to the diagonal corners of the three-dimensional coiled structure.

In addition, the three-dimensional pulsating heat pipe 1*d* may operate in different positions since the three-dimensional coiled structure has different effective pipe cross-sectional areas on two sides thereof (e.g., the two long sides of the three-dimensional coiled structure adjacent to the heat receiving section Hd). For example, the three-dimensional pulsating heat pipe 1*d* can be placed upside down as shown in FIG. 9. In this position, the heat receiving section Hd is located above the heat dissipation section Dd, and the three-dimensional pulsating heat pipe 1*d* is still able to perform at a desired level.

Figure 10:
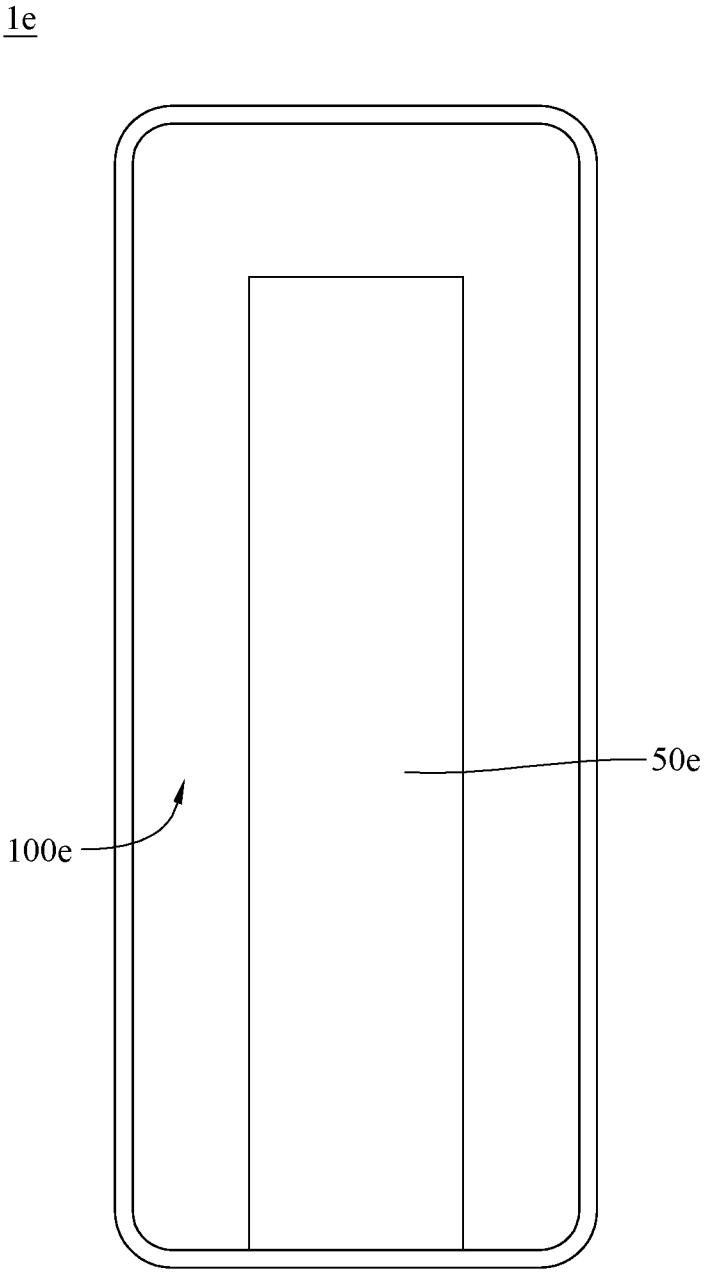
FIG. 10 is a front view of a three-dimensional pulsating heat pipe in accordance with a fifth embodiment of the disclosure.

Then, please refer to FIG. 10, which is a front view of a three-dimensional pulsating heat pipe in accordance with a fifth embodiment of the disclosure. The fifth embodiment provides a three-dimensional pulsating heat pipe 1*e*. The three-dimensional pulsating heat pipe 1*e* has a configuration similar to that of the three-dimensional pulsating heat pipe 1 in the first embodiment. The three-dimensional pulsating heat pipe le has a three-dimensional coiled structure forming a storage space 100*e*, and the storage space 100*e* is configured for an object 50*e* to be placed therein. That is, the three-dimensional coiled structure of the three-dimensional pulsating heat pipe le can also be taken as a storage frame for efficiently utilizing the available space in the three-dimensional coiled structure. The object 50*e* may be, for example, a circuit structure, a mechanism or a heat-dissipation unit, but the disclosure is not limited thereto.

Figure 11:
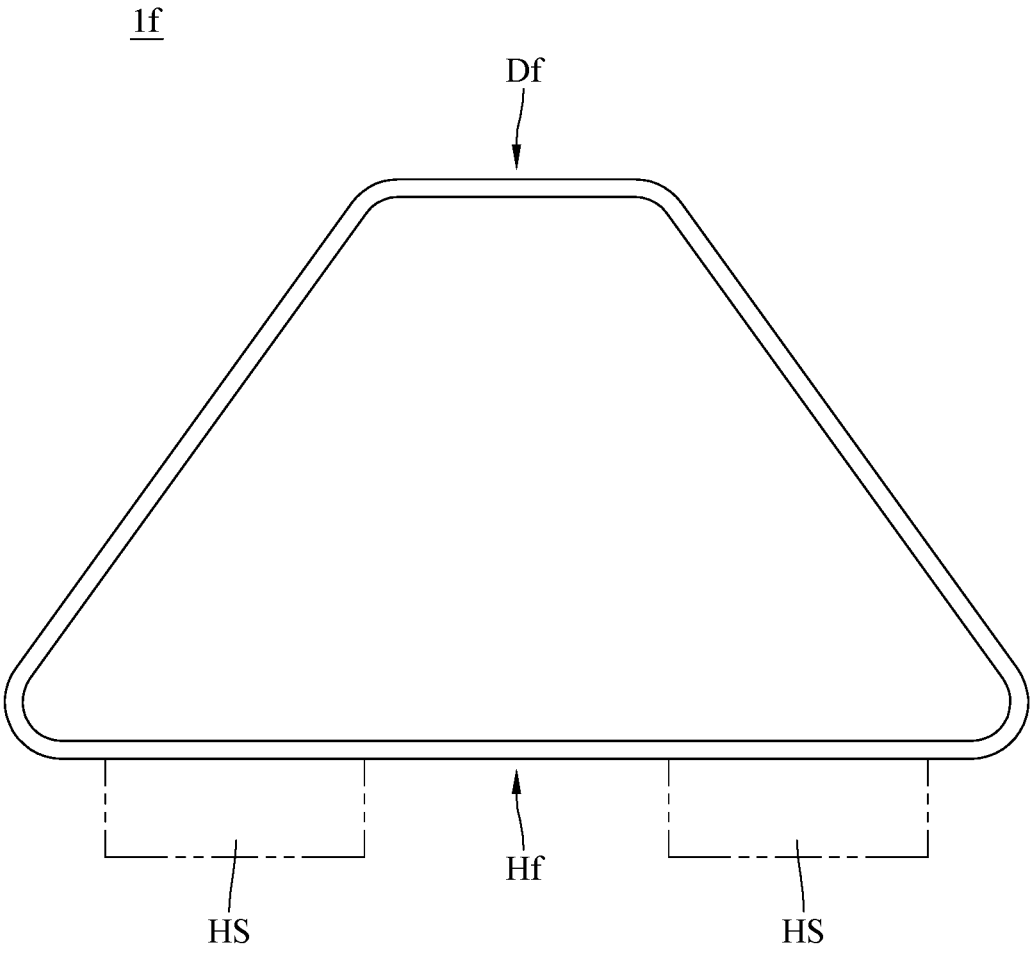
FIG. 11 is a front view of a three-dimensional pulsating heat pipe in accordance with a sixth embodiment of the disclosure.

In this or another embodiment, the heat receiving section of the three-dimensional coiled structure may be longer for in thermal contact with more than one heat sources. For example, please refer to FIG. 11, which is a front view of a three-dimensional pulsating heat pipe in accordance with a sixth embodiment of the disclosure.

The sixth embodiment provides a three-dimensional pulsating heat pipe 1*f*. The three-dimensional pulsating heat pipe 1*f* has a configuration similar to that of the three-dimensional pulsating heat pipe 1 in the first embodiment. One of the differences between these two embodiments is that the three-dimensional pulsating heat pipe 1*f* has a heat receiving section Hf longer than a heat dissipation section Df, allowing the heat receiving section Hf to be in thermal contact with more than one heat sources HS.

Figure 12:
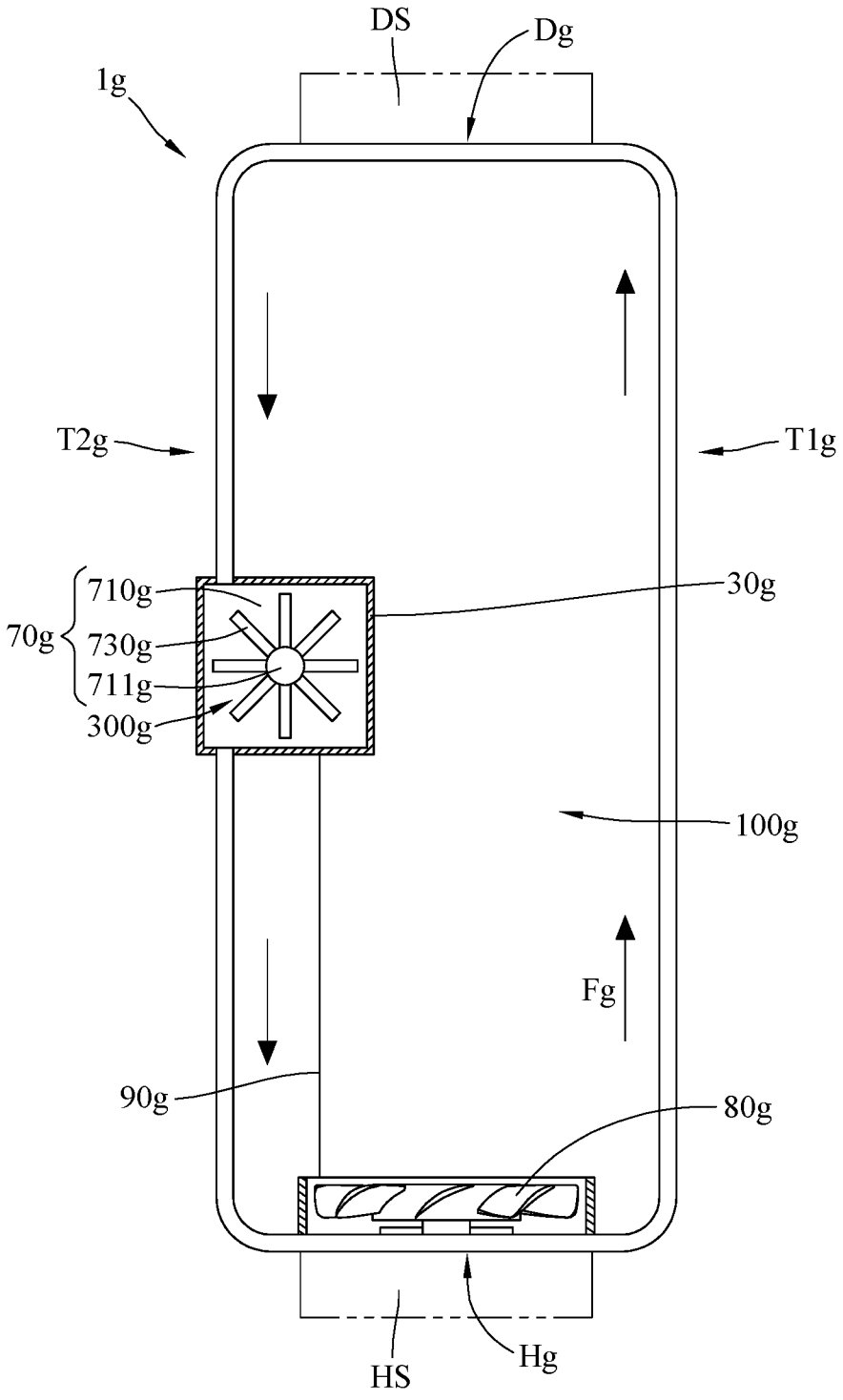
FIG. 12 is a front view of a heat dissipation module in accordance with a seventh embodiment of the disclosure.

In addition, the disclosure is not limited to the connecting member as discussed in the previous embodiments. In other embodiments, the connecting member may contain a generator set that can generate electricity by being driven by the working fluid. Specifically, please refer to FIG. 12, which is a front view of a heat dissipation module in accordance with a seventh embodiment of the disclosure.

The seventh embodiment provides a heat dissipation module including a connecting member 30*g*, a generator set 70*g*, a fan 80*g*, a transmission cable 90*g* and a three-dimensional pulsating heat pipe 1*g*. The three-dimensional pulsating heat pipe lg has a configuration similar to that of the three-dimensional pulsating heat pipe 1 in the first embodiment. As shown in the figure, the three-dimensional pulsating heat pipe 1*g* has a heat receiving section Hg, a first adiabatic section T1*g*, a second adiabatic section T2*g* and a heat dissipation section Dg. And there are a heat source HS in thermal contact with the heat receiving section Hg and a cold source DS in thermal contact with the heat dissipation section Dg. In this embodiment, the second adiabatic section T2*g* has a smaller effective pipe cross-sectional area than the first adiabatic section Tlg, such that, as discussed in the previous embodiments, the working fluid in the three-dimensional pulsating heat pipe 1*g* tends to flow along a direction Fg shown in FIG. 12 as the heat receiving section Hg receives heat produced by the heat source HS.

In addition, the generator set 70*g* is located in the connecting member 30*g* and electrically connected to the fan 80*g* via the transmission cable 90*g*. In more detail, the connecting member 30*g* has a chamber 300*g* connected to the closed loop in the three-dimensional pulsating heat pipe 1*g*. The generator set 70*g* includes a generator 710*g* and a blade wheel 730*g* which are located in the chamber 300*g*. Specifically, the generator 710*g* has a transmission shaft 711*g*, and the blade wheel 730*g* is fixed on the transmission shaft 711*g*. The fan 80*g* is disposed in a storage space 100*g* of the three-dimensional coiled structure of the three-dimensional pulsating heat pipe 1*g* and disposed near the heat receiving section Hg, and the transmission cable 90*g* is electrically connected to the generator 710*g* and the fan 80*g*.

In such a configuration, while the working fluid flows through the connecting member 30*g*, it forces the blade wheel 730*g* to spin so as to spin the transmission shaft 711*g*, such that the transmission shaft 711*g* drives the generator 710*g* to produce electrical energy. Electrical energy is transmitted to the fan 80 via the transmission cable 90*g*. As a result, the fan 80*g* is activated and blows air towards the heat receiving section Hg for cooling.

Accordingly, the heat energy produced by the heat source HS forces the working fluid to flow, and the kinetic energy of the working fluid is turned into mechanical energy of rotation and then turned into electrical energy by the generator set 70*g*. In short, due to the generator set 70*g*, the heat dissipation module is allowed to utilize the waste heat from the heat source HS.

Figure 13:
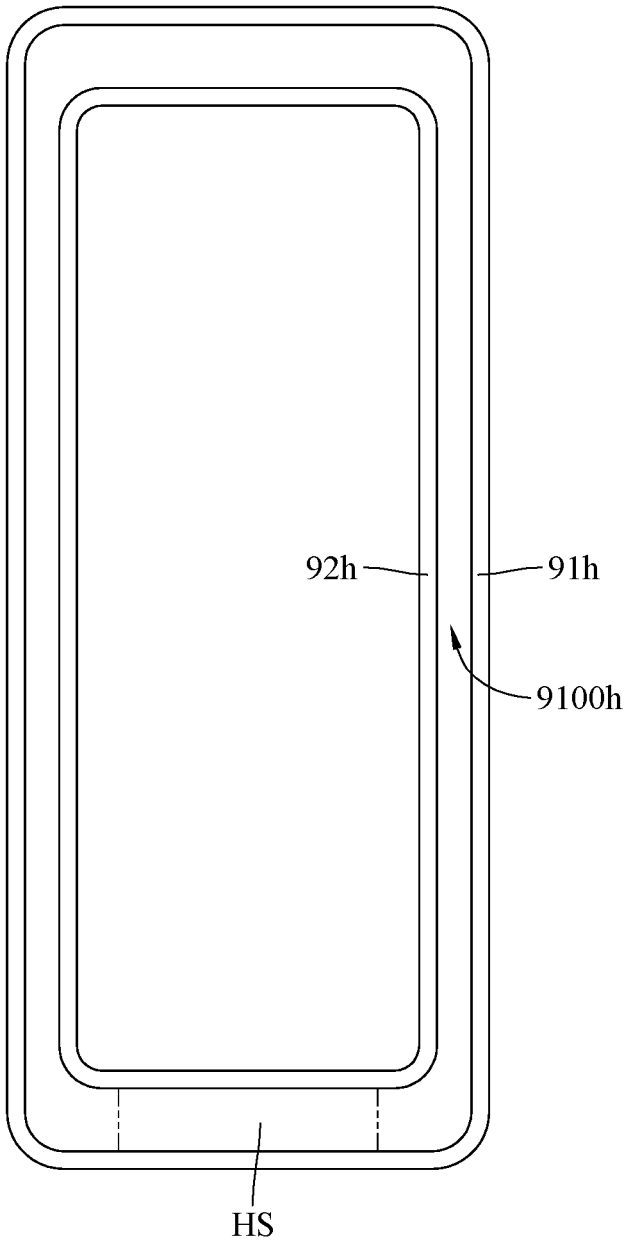
FIG. 13 is a front view of a three-dimensional pulsating heat pipe assembly in accordance with an eighth embodiment of the disclosure.

Then, please refer to FIG. 13, which is a front view of a three-dimensional pulsating heat pipe assembly in accordance with an eighth embodiment of the disclosure. The eighth embodiment provides a three-dimensional pulsating heat pipe assembly 9*h* including two three-dimensional pulsating heat pipes 91*h* and 92*h* that are similar in configuration but different in size. The three-dimensional pulsating heat pipe 91*h* has a three-dimensional coiled structure forming a storage space 9100*h*, and the three-dimensional pulsating heat pipe 92*h* is disposed in the storage space 9100*h*. Therefore, the three-dimensional pulsating heat pipe assembly 9*h* is a dual-layer heat transfer module, and the heat source HS can be thermally disposed between the three-dimensional pulsating heat pipes 91*h* and 92*h*.

In addition, the three-dimensional pulsating heat pipes 91*h* and 92*h* may be filled with the same or different types of working fluids for operating in the same or difference working temperatures. For example, in the case that the pressure in the closed loop is approximately 0.3 atmospheres and the working fluid is water, the working fluid starts to evaporate as it is heated to 69° C. for circulating the working fluid; in the case that the pressure is the same and the working fluid is acetone, the working fluid only needs to be heated to 37° C. to start to evaporate. As such, the three-dimensional pulsating heat pipes 91*h* and 92*h* can be filled with different types of working fluids in order to deal with different areas of the heat source or different heat sources that have different temperatures.

Figure 14:
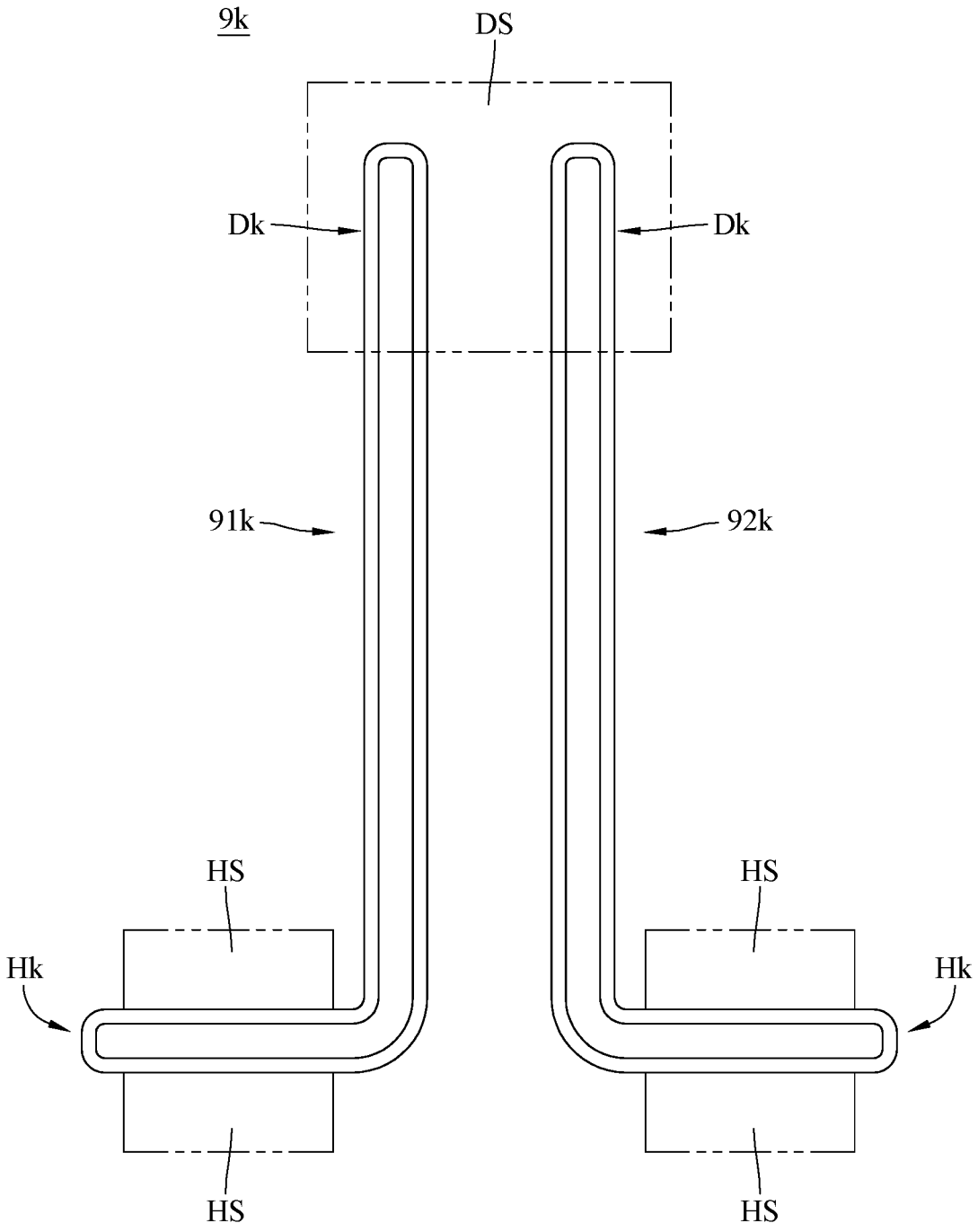
FIG. 14 is a front view of a three-dimensional pulsating heat pipe assembly in accordance with a ninth embodiment of the disclosure.

Then, please refer to FIG. 14, which is a front view of a three-dimensional pulsating heat pipe assembly in accordance with a ninth embodiment of the disclosure.

The ninth embodiment provides a three-dimensional pulsating heat pipe assembly 9*k* including two three-dimensional pulsating heat pipes 91*k* and 92*k* that have a configuration similar to that of the three-dimensional pulsating heat pipe 1 in the first embodiment but each is a L-shaped three-dimensional coiled structure. In such a case, each of the three-dimensional pulsating heat pipes 91*k* and 92*k* has a heat receiving section Hk and a heat dissipation section Dk located on two opposite ends of the L-shaped three-dimensional coiled structure. As shown in the figure, the three-dimensional pulsating heat pipes 91*k* and 92*k* may be placed in a mirror-symmetrical manner, such that their heat receiving sections Hk are located away from each other for cooling two heat sources HS and their heat dissipation sections Dk are located adjacent to each other to be adjacent to one or more cold sources DS.

Figure 15:
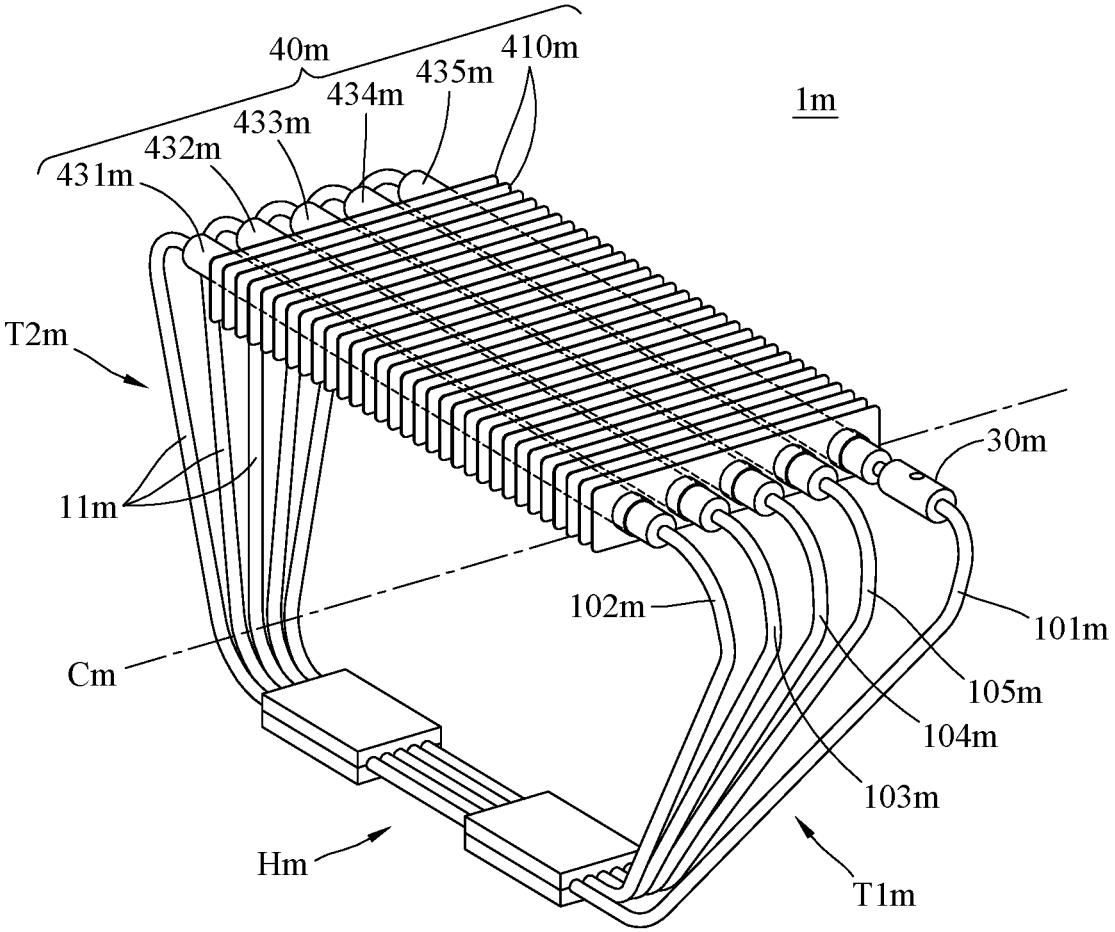
FIG. 15 is a perspective view of a heat dissipation module in accordance with a tenth embodiment of the disclosure.
Figure 16:
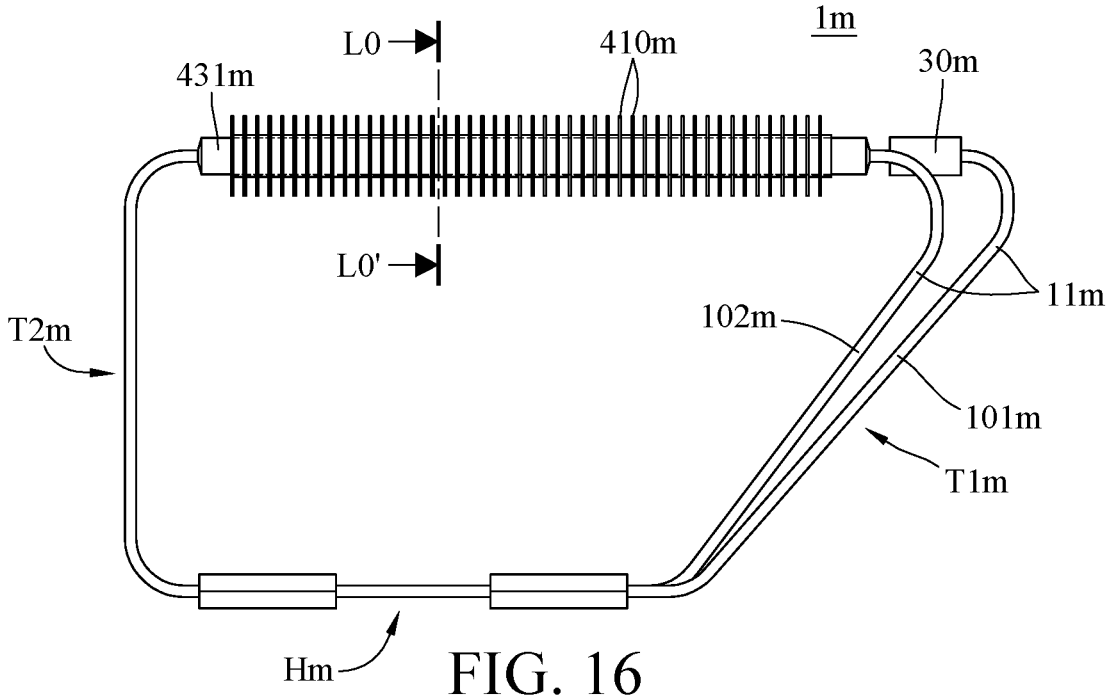
FIG. 16 is a front view of the heat dissipation module in FIG. 15.
Figure 17:
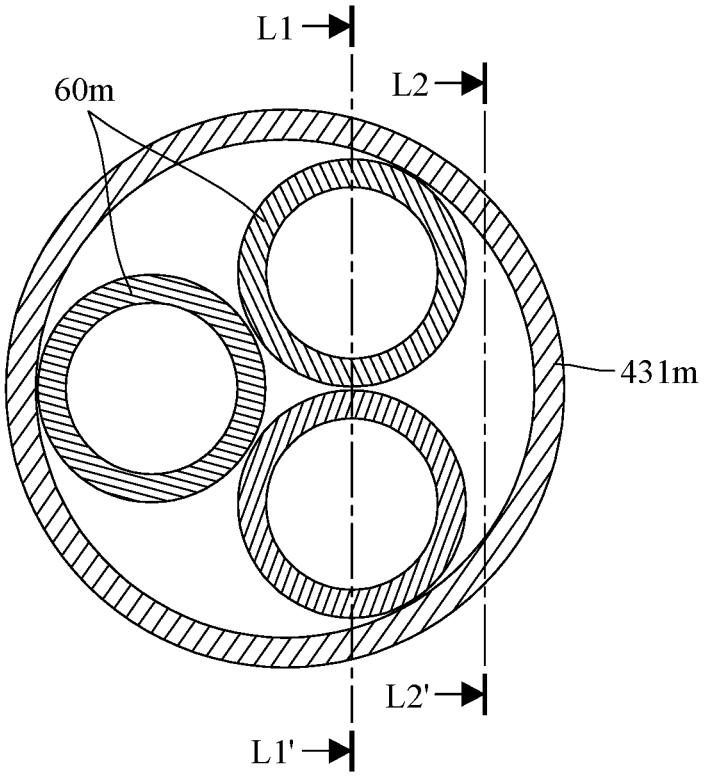
FIG. 17 is a cross-sectional view of one heat dissipation pipe and fillings therein taken along line L0-L0' of FIG. 16.
Figure 18:
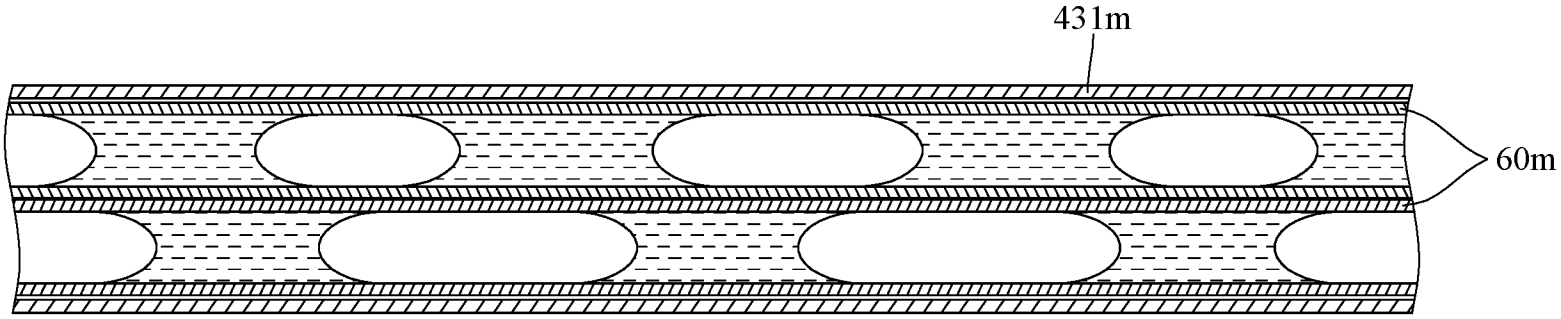
FIG. 18 is a cross-sectional view taken along line L1-L1' of FIG. 17.
Figure 19:
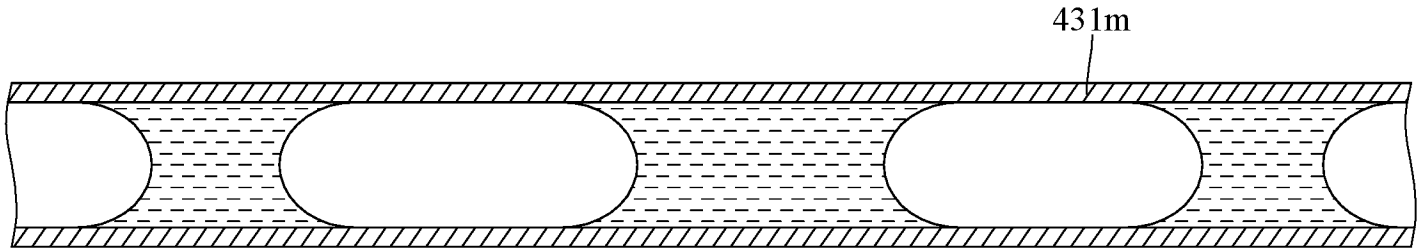
FIG. 19 is a cross-sectional view taken along line L1-L2' of FIG. 17.

Then, please refer to FIG. 15 to FIG. 19, FIG. 15 is a perspective view of a heat dissipation module in accordance with a tenth embodiment of the disclosure, FIG. 16 is a front view of the heat dissipation module in FIG. 15, FIG. 17 is a cross-sectional view of one heat dissipation pipe and fillings therein taken along line L0-L0' of FIG. 16, FIG. 18 is a cross-sectional view taken along line L1-L1' of FIG. 17, and FIG. 19 is a cross-sectional view taken along line L1-L2' of FIG. 17.

The tenth embodiment provides a heat dissipation module lm that is applicable to an electronic device such as a projector (not shown). The heat dissipation module 1*m* includes a fin-and-tube heat exchanger 40*m*, a plurality of fillings 60*m*, a plurality of pipe members 101*m* to 105*m* and a connecting member 30*m*.

The fin-and-tube heat exchanger 40*m* includes a plurality of fins 410*m* and a plurality of heat dissipation pipes 431*m* to 435*m*. The heat dissipation pipes 431*m* to 435*m* are respectively disposed through the fins 410*m*. The fillings 60*m* are, for example, hollow tubes disposed in the heat dissipation pipes 431*m* to 435*m*.

The pipe members 101*m* to 105*m*, the heat dissipation pipes 431*m* to 435*m* and the connecting member 30*m* are connected in series to form a closed loop. In detail, one end of the pipe member 101*m* is connected to one end of the heat dissipation pipe 431*m*, two ends of the pipe member 102*m* are respectively connected to one end of the heat dissipation pipe 432*m* and the other end of the heat dissipation pipe 431*m*, two ends of the pipe member 103*m* are respectively connected to one end of the heat dissipation pipe 433*m* and the other end of the heat dissipation pipe 432m, two ends of the pipe member 104*m* are respectively connected to one end of the heat dissipation pipe 434*m* and the other end of the heat dissipation pipe 433*m*, two ends of the pipe member 105*m* are respectively connected to one end of the heat dissipation pipe 435*m* and the other end of the heat dissipation pipe 434*m*. As such, the pipe members 101*m* to 105*m*, the heat dissipation pipes 431*m* to 435*m* together form a continuous flow path. The connecting member 30*m* is connected to two ends of the continuous flow path (e.g., the connecting member 30*m* is connected to the pipe member 101*m* and the heat dissipation pipe 435*m*) so as to form the closed loop.

In addition, the continuous flow path surrounds an axis Cm to form a plurality of loop portions 11*m*, and the loop portions 11*m* are arranged in order along the axis Cm so as to form a three-dimensional coiled structure. The three-dimensional coiled structure has a heat receiving section Hm on one side thereof, and the fin-and-tube heat exchanger 40*m* is located on the side opposite to the heat receiving section Hm. In addition, the three-dimensional coiled structure further has a first adiabatic section T1*m* and a second adiabatic section T2*m* located between the heat receiving section Hm and the fin-and-tube heat exchanger 40*m*.

The pipe members 101*m* to 105*m* in the first adiabatic section T1*m* each have an effective pipe cross-sectional area different from that in the second adiabatic section T2*m*. And a working fluid can be filled in the closed loop for transferring heat.

In addition, the connecting member 30 may be connected to an external fluid source (not shown) so as to receive working fluid and provide it into the closed loop. As the closed loop is filled to the desired filling ration, the connecting member 30*m* and the external fluid source may be disconnected and sealed, but the disclosure is not limited thereto. In other embodiments, in order to repeatedly fill the working fluid, the joint between the connecting member 30 and the external fluid source may be replaced by a vacuum safety valve. It is noted that the connecting members 30*m* may be applied to other embodiments.

It is specified that the pipe cross-sectional area of each of the heat dissipation pipes 431*m* to 435*m* is larger than a theoretical critical area of a pulsating heat pipe. As such, the working fluid may not form an interspersed vapor bubbles and liquid slugs in the heat dissipation pipes 431*m* to 435*m*, thereby unable to satisfy the operation requirements of a pulsating heat pipe. Therefore, in this embodiment, the heat dissipation pipes 431*m* to 435*m* are filled with the fillings 60*m* (as shown in FIG. 17), and the inner diameter of the fillings 60*m* and the effective hydraulic diameter of the cross-sectional area of each channel formed in the heat dissipation pipes 431*m* to 435*m* satisfy the theoretical inner diameter range of a pulsating heat pipe, allowing the existence of an interspersed vapor bubbles and liquid slugs in the heat dissipation pipes 431*m* to 435*m* (as shown in FIG. 18 and FIG. 19). As such, the fillings 60*m* help the closed loop to meet the basic operation requirements of a pulsating heat pipe.

However, the disclosure is not limited to the configuration of the fillings 60*m*. In other embodiments, each filling may be solid; in such a case, the working fluid may flow through the gaps among the fillings and the inner surface of the heat dissipation pipe. Therefore, it is understood that the difference in effective pipe cross-sectional area may be achieved by filling a portion of the closed loop.

According to the three-dimensional pulsating heat pipe, the three-dimensional pulsating heat pipe assembly and the heat dissipation module as described above, the adjacent loop portions are in tight contact with each other so as to prevent the existence of a gap in the axial direction therebetween, which helps to prevent an invalid contact area between the heat receiving section and the heat source, thereby increasing heat transfer rate.

Furthermore, the working fluid automatically flows along a specific direction due to the unbalanced flow resistance on two sides of the heat receiving section caused by difference between the effective pipe cross-sectional areas of the adiabatic sections, thus the three-dimensional pulsating heat pipe is able to operate at the desired level for cooling whether it is being placed horizontally or in an upside-down position.

In addition, in some embodiments, since the pipe member of the three-dimensional pulsating heat pipe is coiled around an axis to form the loop portions and the loop portions are tightly stacked on one another, the loop portions together form a compact contact surface with small or no gaps thereon, such that the three-dimensional pulsating heat pipe does not require a small radius of curvature of the pipe member to increase effective thermal contact area, thereby does not require additional specific jigs for bending task, either. Accordingly, the three-dimensional pulsating heat pipe of the present disclosure features low manufacturing cost in comparison with the conventional pulsating heat pipes.

Moreover, in yet some embodiments, the three-dimensional coiled structure formed by the three-dimensional pulsating heat pipe is able to accommodate and support one or more objects, such as a circuit structure, a mechanism or a heat-dissipation unit for efficiently utilizing the available space in the three-dimensional coiled structure.

Additionally, in still some embodiments, the connecting member further contains a generator set that is able to turn the mechanical energy of rotation of the working fluid into electrical energy for the fan to cool the heat receiving section, thereby utilizing the waste heat from the heat source.

Further, the three-dimensional coiled structure is not restricted in shape, and it can be further formed in various shapes, such as rectangle, trapezoid, triangle, oval or in an L shape, according to actual design requirements. Other than that, the three-dimensional coiled structure can be coupled to different heat dissipation pipes in the market, such that the three-dimensional pulsating heat pipe is applicable to various types of heat dissipation modules.

The embodiments were chosen and described in order to best explain the principles of the disclosure and its practical applications, to thereby enable others skilled in the art to best utilize the disclosure and various embodiments with various modifications as are suited to the particular use contemplated. It is intended that the scope of the disclosure be defined by the following claims and their equivalents.

What is claimed is:

1. A heat dissipation module, comprising:

a fin-and-tube heat exchanger, comprising a plurality of fins and a plurality of heat dissipation pipes, and the plurality of heat dissipation pipes disposed through the plurality of fins;

a plurality of first fillings, disposed in the plurality of heat dissipation pipes;

a plurality of pipe members, wherein the plurality of pipe members each have a smaller pipe cross-sectional area than that of each of the plurality of heat dissipation pipes, the plurality of pipe members are connected to the plurality of heat dissipation pipes so as to form a continuous flow path including a plurality of loop portions that surround an axis, the plurality of loop portions are arranged in order along the axis so as to form a three-dimensional coiled structure, the three-dimensional coiled structure has a heat receiving section, the heat receiving section and the fin-and-tube heat exchanger are respectively located at two opposite sides of the three-dimensional coiled structure, and the pipe member has different effective pipe cross-sectional areas on two opposite sides adjacent to the heat receiving section; and a connecting member, connected to two ends of the continuous flow path, such that the connecting member, the plurality of pipe members and the plurality of heat dissipation pipes together form a closed loop.

2. The heat dissipation module according to claim 1, wherein the three-dimensional coiled structure further has two adiabatic sections located between the heat receiving section and the fin-and-tube heat exchanger, each of the plurality of pipe members in at least a part of one of the adiabatic sections has a first effective pipe cross-sectional area, and each of the plurality of pipe members in at least a part of the other adiabatic section has a second effective pipe cross-sectional area which is different from the first effective pipe cross-sectional area.

3. The heat dissipation module according to claim 2, wherein the heat receiving section is located at a level higher than the fin-and-tube heat exchanger.

4. The heat dissipation module according to claim 2, wherein the heat receiving section and the fin-and-tube heat exchanger are located at a same level.

5. The heat dissipation module according to claim 2, wherein a ratio of the first effective pipe cross-sectional area to the second effective pipe cross-sectional area ranges from 0.3 to 0.7.

6. The heat dissipation module according to claim 1, further comprising a second filling, wherein the three-dimensional coiled structure further has a first adiabatic section and a second adiabatic section, the first adiabatic section and the second adiabatic section are located between the heat receiving section and the fin-and-tube heat exchanger, the second filling is located in one of the plurality of pipe members in the first adiabatic section so that the one of the plurality of pipe members in the first adiabatic section has a smaller effective pipe cross-sectional area than that in the second adiabatic section.

7. The heat dissipation module according to claim 1, wherein the plurality of loop portions are stacked on one another along the axis.

8. The heat dissipation module according to claim 1, wherein an inner diameter of each of the plurality of pipe members ranges from 1.0 mm to 8.0 mm.

9. The heat dissipation module according to claim 1, wherein a working fluid is filled into the plurality of pipe members with a filling ratio of 30% to 80%.

10. The heat dissipation module according to claim 1, wherein the three-dimensional coiled structure is rectangular, trapezoidal, triangular, oval, or in an L shape.

11. The heat dissipation module according to claim 1, wherein the heat receiving section and the fin-and-tube heat exchanger are the same in length.

12. The heat dissipation module according to claim 1, wherein the heat receiving section and the fin-and-tube heat exchanger are different in length.

13. The heat dissipation module according to claim 1, wherein the three-dimensional coiled structure forms a storage space.

* * * * *